US007637303B2

(12) United States Patent
Hunter

(10) Patent No.: US 7,637,303 B2
(45) Date of Patent: Dec. 29, 2009

(54) METHOD AND APPARATUS FOR CONVEYING SAND MOLDS TO A METAL POURING MACHINE

(75) Inventor: William Allan Hunter, Palatine, IL (US)

(73) Assignee: Hunter Automated Machinery Corporation, Schaumburg, IL (US)

( * ) Notice: Subject to any disclaimer, the term of this patent is extended or adjusted under 35 U.S.C. 154(b) by 423 days.

(21) Appl. No.: 11/500,201

(22) Filed: Aug. 7, 2006

(65) Prior Publication Data

US 2008/0029238 A1 Feb. 7, 2008

(51) Int. Cl.
*B22D 47/00* (2006.01)

(52) U.S. Cl. ..... 164/130; 164/324

(58) Field of Classification Search ..... 164/18, 164/20, 129, 130, 322, 323, 324
See application file for complete search history.

(56) References Cited

U.S. PATENT DOCUMENTS 3,682,236 A * 8/1972 Becke ..... 164/324
4,299,269 A * 11/1981 Friesen et al. ..... 164/324
4,589,467 A * 5/1986 Hunter ..... 164/326
4,590,982 A 5/1986 Hunter
4,657,064 A 4/1987 Hunter
4,671,339 A 6/1987 Hunter
4,699,199 A 10/1987 Hunter
4,738,299 A 4/1988 Hunter
4,840,218 A 6/1989 Hunter
4,848,440 A 7/1989 Hunter
4,890,664 A 1/1990 Hunter
5,022,512 A 6/1991 Hunter
5,062,465 A * 11/1991 Mortensen ..... 164/4.1
5,069,268 A 12/1991 Hunter
5,101,881 A 4/1992 Hunter
5,170,836 A 12/1992 Hunter
5,343,928 A 9/1994 Hunter
5,402,938 A 4/1995 Sweeney
5,853,042 A 12/1998 Hunter
5,901,774 A 5/1999 Hunter et al.
5,927,374 A 7/1999 Hunter et al.
5,971,059 A 10/1999 Hunter et al.
6,015,007 A 1/2000 Hunter et al.
6,145,577 A 11/2000 Hunter et al.
6,263,952 B1 7/2001 Hunter
6,533,022 B2 3/2003 Hunter
6,571,860 B2 6/2003 Hunter et al.
6,622,772 B1 9/2003 Hunter
6,779,586 B2 8/2004 Hunter et al.
6,817,403 B2 11/2004 Hunter
7,150,310 B2 12/2006 Hunter et al.
2005/0109478 A1 5/2005 Hunter et al.

* cited by examiner

*Primary Examiner*—Kevin P Kerns
(74) *Attorney, Agent, or Firm*—Pauley Petersen & Erickson

(57) ABSTRACT

Method and apparatus for feeding sand molds from multiple sand mold forming stations to a common metal pouring station. The method and apparatus of this invention utilize walking-beam-type conveyors having spaced apart fixed outboard rails and a central reciprocating rail. Walking-beam conveyors are disposed in perpendicular directions with a junction therebetween that allows for a perpendicular change in direction. The method and apparatus of this invention allow multiple parallel walking-beam conveyors to feed sand molds to a single junction for transfer to a metal pouring station.

18 Claims, 3 Drawing Sheets

METHOD AND APPARATUS FOR CONVEYING SAND MOLDS TO A METAL POURING MACHINE

BACKGROUND OF THE INVENTION

1. Field of the Invention

This invention is directed to conveyors for feeding sand molds for metal casting from a forming machine to a metal pouring station. The method provides a method and apparatus for automatically and continually feeding prepared sand molds from multiple forming machines to a common pouring station using walking beam-type mold conveyors.

2. Discussion of Related Art

Molded metal castings are commoniy manufactured at foundries through a matchplate molding technique which employs green sand molds comprised of prepared sand and additives which are compressed around cope and drag patterns mounted on opposite sides of a matchplate. The sand mold is thus formed in upper and lower matching portions, an upper cope mold, and a lower drag mold. The cope mold is formed in a separate cope flask which is filled with prepared sand and compacted onto the matchplate. The matchplate is then removed leaving an indentation in the cope mold of the desired shape for the upper portion of the casting. Simultaneously, the drag mold is formed in a separate drag flask. Usually the matchplate is in the form of a planar member with the pattern for the cope mold on one side and the pattern for the drag mold on the other. After the cope and drag molds have been formed, they are placed together to form a unitary mold having an interior cavity of the desired shape. The cavity can then be filled with molten metal through an inlet or "sprue" provided in the cope mold to create the desired casting. Such a system is disclosed in U.S. Pat. No. 5,022,521, issued to Hunter, herein incorporated by reference.

As with many volume sensitive production operations, manufacturers are required to automate the manufacturing process in order to remain competitive. Foundries engaging in the casting of metal objects through the use of green sand molds are not immune to this reality. It is common in today's marketplace, for the machine which produces the sand molds to be connected to a machine which fills the sand mold with molten metal, which in turn is connected to a machine for cooling the molten metal into a solid casting, which in turn is connected to a machine for removing the sand mold and revealing the casting for harvest. Such a system is disclosed in U.S. Pat. No. 4,589,467, issued to Hunter, herein incorporated by reference.

In the aforementioned '467 patent, the sand molds are manufactured and communicated along a linear conveyor to a circular, rotating, or "carousel" conveyor. Molten metal is introduced into the molds at one location on the carousel and the molten metal is then allowed to cool within the sand mold as the carousel rotates. The carousel is provided with both an outer diameter track and an inner diameter track which provides for additional cooling of the metal, and which increase the throughput of the machine.

There is a need for an improved conveyor system for transporting sand molds from the machine that produces the sand mold to, for example, the carousel conveyor.

SUMMARY OF THE INVENTION

A general object of the invention is to provide a mold conveyor that feeds molds from more than one origin, e.g., a mold forming device, to a common destination, e.g., a metal pouring station.

The general object of the invention can be attained, at least in part, through a method for conveying a sand mold with an accumulating conveyor. The accumulating conveyor includes a first transfer conveyor in conveying combination with a second transfer conveyor. Each of the first and second transfer conveyors is a walking-beam-type conveyor that includes a transfer rail movable with respect to at least one stationary fixed rail. The sand mold moves along the first transfer conveyor in a first direction, is transferred from the first transfer conveyor to the second transfer conveyor, and then moves along the second transfer conveyor in a second direction that is different than the first direction.

In one embodiment of this invention, the method for conveying sand molds begins by depositing a first sand mold on a first transfer conveyor, such as from a sand mold forming device in combination with the first transfer conveyor. The first transfer conveyor includes two outboard rails and a central transfer rail movable between the two outboard rails. The first sand mold moves along the first transfer conveyor in a first direction and is placed on a first junction resting station. The first junction resting section is at a downstream end of the first transfer conveyor, and an upstream end of a second transfer conveyor, which similarly includes two outboard rails and a central transfer rail movable between the two outboard rails.

The central transfer rail of the second transfer conveyor moves under and lifts the sand mold off the first junction resting station and moves the first sand mold along the second transfer conveyor in a second direction that is different than, and desirably perpendicular to, the first direction. The central transfer rail of the second transfer conveyor places the first sand mold on a second junction resting station that is at a downstream end of the second transfer conveyor.

Desirably operating simultaneously, a second forming machine deposits a second sand mold on a third transfer conveyor. The third transfer conveyor also includes a central transfer rail movable between two fixed outboard rails. The central transfer rail moves the second sand mold along the third transfer conveyor in a third direction that is also different than, e.g., perpendicular to, the second direction. The central transfer rail places the second sand mold on the second junction resting station, which is also at a downstream end of the third transfer conveyor. Only one of the first and second sand molds is placed on the second junction resting station at a time. A pusher mechanism is used to transfer the sand mold from the second junction resting station to a metal pouring station.

The invention further provides an apparatus for conveying sand molds. The apparatus includes a first transfer conveyor oriented in a first direction and including a transfer rail movable, and generally reciprocating, with respect to a fixed rail, and desirably between two outboard fixed rails, and a second similar transfer conveyor in conveying combination with the first transfer conveyor and oriented in a second direction that is different than the first direction. The apparatus of this invention is an accumulating mold conveyor that can feed sand molds from multiple sand mold forming machines to a single metal pouring station. The apparatus and method of this invention provide improved flexibility and efficiency for automated matchplate molding techniques.

The invention further provides an apparatus for conveying sand molds including a transfer conveyor that has one or more transfer rails movable with respect to one or more fixed rails. The transfer rail includes a frame base and a plurality of carrier plates thereon. Each of the plurality of carrier plates is attached along the frame by a pressurized fluid lift mechanism adapted to lift and lower both a corresponding carrier plate and a sand mold disposed on the carrier plate. Sensor mechanisms are desirably positioned along the transfer conveyor to determine the presence of a sand mold above a carrier plate, thereby determining whether the carrier plate needs to be lifted.

BRIEF DESCRIPTION OF THE DRAWINGS

These and other objects and features of this invention will be better understood from the following detailed description taken in conjunction with the drawings, wherein.

DEFINITIONS

Within the context of this specification, each term or phrase below will include the following meaning or meanings.

References herein to "conveying combination" are to be understood to refer to a combination of two elements, such as two conveyors, whereby an item conveyed by one element is transferable to the other element for continued conveyance to the intended destination.

References herein to "upstream" and "downstream" are to be understood with reference to directions of travel of molds on a conveyor. "Upstream" refers to a direction toward a place of origin, such as a mold forming device, and "downstream" refers to a direction toward a place of destination.

DESCRIPTION OF PREFERRED EMBODIMENTS

Figure 1:
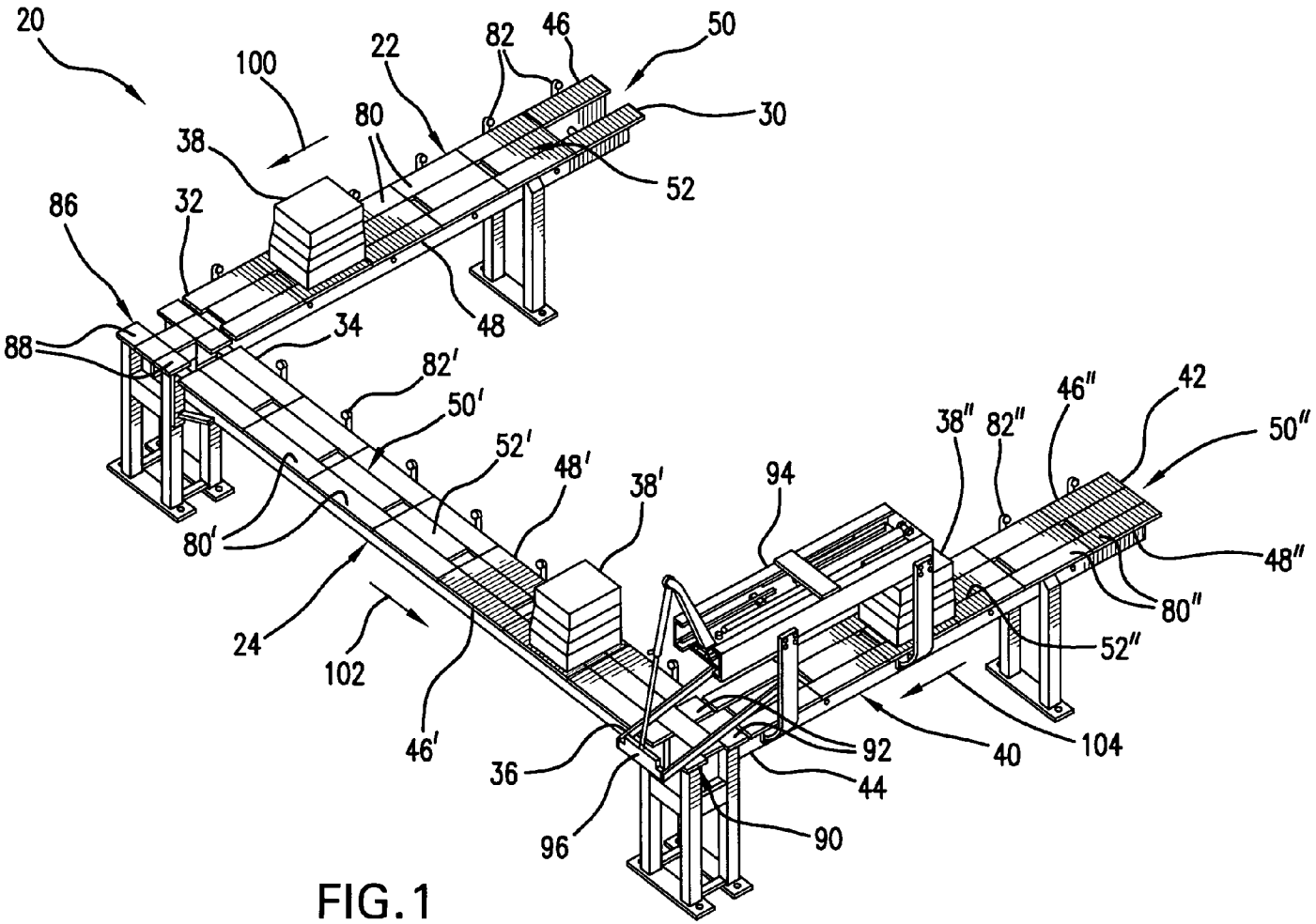
FIG. 1 is a perspective view of an accumulating mold conveyor according to one embodiment of this invention.

Referring to FIG. 1, this invention provides a conveyor assembly, shown as accumulating mold conveyor 20, for transporting sand molds from more than one sand mold forming station to a metal pouring station, such as are described in, for example, U.S. Pat. No. 6,145,577, issued to Hunter, and herein incorporated by reference.

Accumulating mold conveyor 20 includes first transfer conveyor 22 oriented in a first direction, and second transfer conveyor 24 oriented in a second direction. In the embodiment of FIG. 1, first and second transfer conveyors 22 and 24 are disposed perpendicular to each other; however, the conveyors of this invention can be disposed at other angles, depending on need. First transfer conveyor 22 has an upstream end 30 that is to be disposed toward a sand mold forming station (not shown in FIG. 1), and a downstream end 32 opposite the upstream end 30. Similarly, second transfer conveyor 24 has an upstream end 34 and an opposing downstream end 36. Sand molds 38 travel along the conveyors of this invention from an upstream end to a downstream end. Downstream end 32 of first transfer conveyor 22 is in conveying communication with upstream end 34 of second transfer conveyor 24, such that a sand mold is transferred during operation from downstream end 32 of first transfer conveyor 22 to upstream end 34 of second transfer conveyor 24.

Accumulating mold conveyor 20 also includes third transfer conveyor 40 oriented in a third direction that is the same as the first direction, and also perpendicular to the second direction. Third transfer conveyor 40 has an upstream end 42 that is to be disposed toward a second sand mold forming station (not shown in FIG. 1), and a downstream end 44 opposite upstream end 42.

First transfer conveyor 22 includes first outboard rail 46 spaced apart from second outboard rail 48. Outboard rails 46 and 48 can each be formed as a single rail member or from a plurality of smaller individual rail members. A central rail channel 50 is formed between first outboard rail 46 and second outboard rail 48. Central transfer rail 52 is disposed within central rail channel 50, and is movable therein and between the two fixed outboard rails 46 and 48. Second and third transfer conveyors 24 and 40 include components identical or at least similar to first transfer conveyor 22. These components are described with reference to first transfer conveyor 22, and identified by element reference numbers associated with a prime "'" or double prime "''", respectively.

The accumulating mold conveyor of this invention is not limited to the configuration and number of fixed and moveable rails shown in FIG. 1. For example, the center rail(s) can be fixed in place and not moveable, with two or more outboard rails moveable with respect to the fixed center rail(s). Also, in one embodiment of the invention, two moveable transfer rails are disposed on either side of a fixed center rail, and each of the moveable transfer rails is between the center rail and a further fixed outboard rail (e.g., five total rails).

Figure 2:
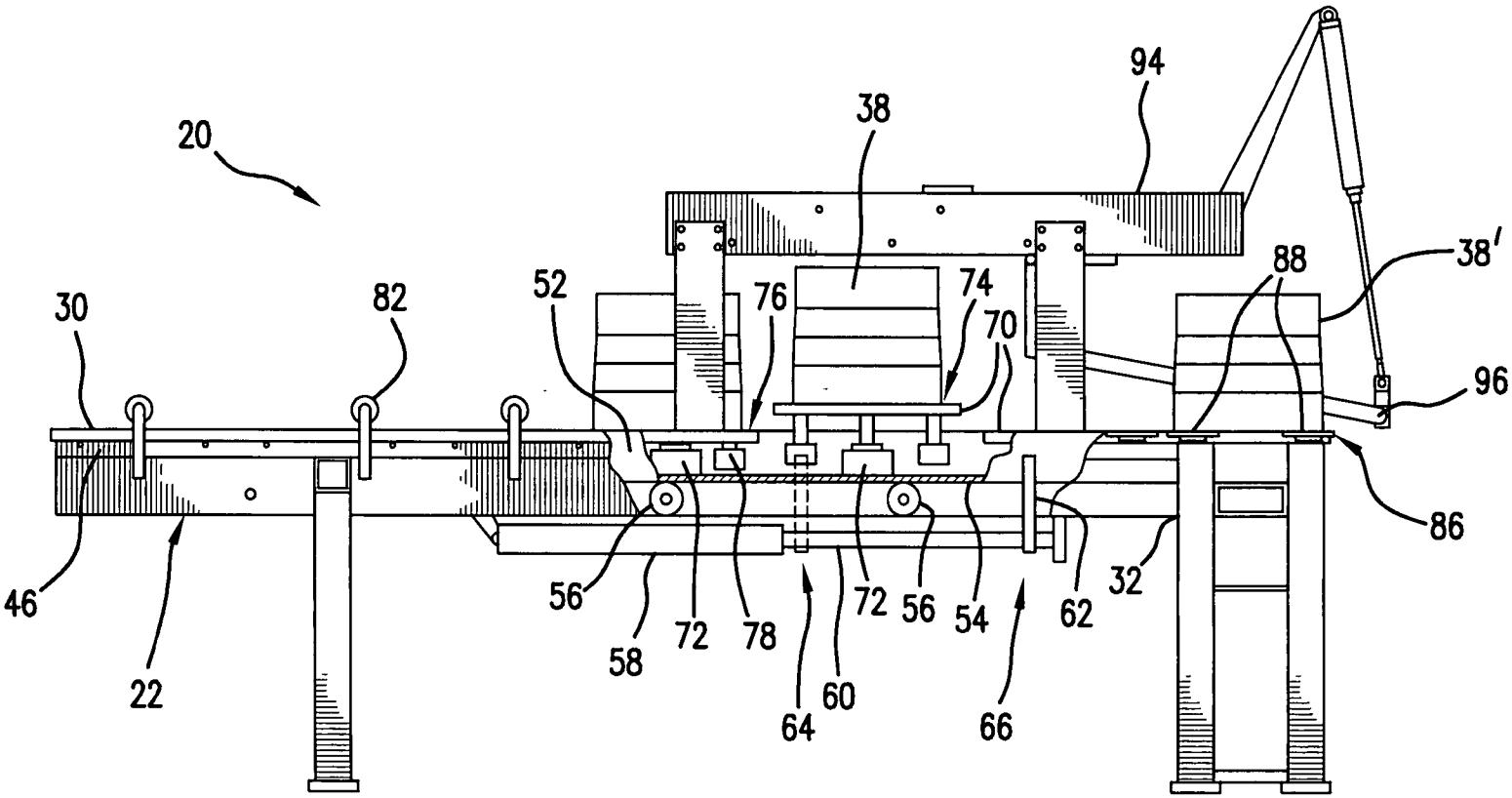
FIG. 2 is a partial sectional side view of the accumulating mold conveyor of FIG. 1.

FIG. 2 is a side view of accumulating mold conveyor 20 showing a partial sectional view of first transfer conveyor 22. Central transfer rail 52 is a reciprocating rail that includes a U-shaped frame 54 disposed upon a plurality of rollers 56. First transfer conveyor 22 includes at least one pressurized fluid piston 58, e.g., a hydraulic piston, having a moveable piston arm 60 connected to frame 54 by connector 62. Piston arm 60, and thus frame 54 and central transfer rail 52, is movable between upstream first position 64 (shown in phantom) to downstream second position 66.

A plurality of sand mold carrier plates 70 is disposed along the frame 54. Each of carrier plates 70 is attached to the frame 54 by one of a plurality of pressurized fluid lift mechanisms 72, e.g., a pneumatically actuated piston. Each of pressurized fluid lift mechanisms 72 is adapted to lift a corresponding one of carrier plates 70, and a sand mold thereon, to lifted position 74, and then to lower the corresponding one of carrier plates 70 to lowered position 76. In lowered position 76, sand molds 38 are disposed on outboard rails 46 and 48. In lifted position 74, sand molds 38 are moved to, and then lowered onto, a downstream position on outboard rails 46 and 48. Each of carrier plates 70 is supported by optional support elements 78 attached to frame 54.

The lifting distance of the sand molds 38 can vary depending on need. In one embodiment of this invention, the sand molds 38 are lifted less than an inch above the outboard rails 46 and 48, and more desirably about $1/16^{th}$ of an inch. In another embodiment, the sand molds are not actually lifted off the outboard rails, but the carrier plates place upward pressure on the sand molds to reduce friction and allow the sand molds to more easily slide along the outboard rails, similar to that disclosed in U.S. Pat. No. 4,890,664.

In the embodiment shown in FIGS. 1 and 2, outboard rails 46 and 48 are periodically laterally grooved to indicate a plurality of sand mold resting positions 80 along first transfer conveyor 22. Each of resting positions 80 are approximately correspondingly sized to the length of each of carrier plates 70. Thus, sand molds 38 are moved along first transfer conveyor 22 by lifting a sand mold 38 off outboard rails 46 and 48 at a first of resting positions 80 with a corresponding one of carrier plates 70, moving the sand mold in a downstream direction with central transfer rail 52 to dispose sand mold 38 over a second of resting positions 80, and lowering sand mold 38 onto outboard rails 46 and 48 at the second of resting positions 80. Central transfer rail 52 then moves back to the first position, and the process repeats to incrementally move, or "walk," sand mold 38 in a downstream direction on first transfer conveyor 22.

A plurality of optional sensor mechanisms 82 is disposed along first transfer conveyor 22. Each of the plurality of sensor mechanisms 82 is desirably disposed in sensing combination with one of resting positions 80. Sensor mechanisms 82 detect the presence of sand molds 38 along first transfer conveyor 22, and can be used to actuate lifting of a corresponding carrier plate 70 when a sand mold 38 is disposed above the corresponding carrier plate 70. Thus, in one embodiment of this invention, a carrier plate 70 is not lifted unless a sand mold 38 is present above. Various and alternative sensor mechanisms are available for the use in the accumulating mold conveyor 20 of this invention, such as, without limitation, motion sensors using visible or infrared light or weight sensors disposed beneath outboard rails 46 and 48.

Accumulating mold conveyor 20 includes first junction resting station 86 disposed between downstream end 32 of first transfer conveyor 22 and upstream end 34 of second transfer conveyor 24. Junction resting station 86 includes four resting pads 88 adapted to hold a sand mold thereon. Each of resting pads 88 is spaced apart from another of the resting pads, and disposed at one of the corners of junction resting station 86. The spacing between each of resting pads 88 is such that central transfer rail 52 is movable between the spaced apart resting pads 88, as shown in FIG. 1, and able to lower sand mold 38 onto resting pads 88. When the central transfer rail 52 of first transfer conveyor 22 is moved out from first junction resting station 86, central transfer rail 52' of second transfer conveyor 24 is moved between the spaced apart resting pads 88. When positioned within first junction resting station 86, central transfer rail 52' of second transfer conveyor is able to lift sand mold 38 off resting pads 88, thereby perpendicularly transferring sand mold 38 to second transfer conveyor 24.

As will be appreciated by those skilled in the art following the teachings herein provided, the number and configuration, e.g., placement, of the resting pads of the junction resting stations will depend on the configuration of the transfer conveyors, e.g., the number of rails and which rail(s) is/are moveable, as discussed above. Also, the invention is not limited to the particular accumulating mold conveyors shown in FIG. 1. Additional types of accumulating mold conveyors, such as are known in the art, can be used with the junction resting stations according to this invention to impart directional change, such as, for example, the conveyors of U.S. Pat. No. 4,890,664, issued to Hunter, and herein incorporated by reference.

Accumulating mold conveyor 20 includes second junction resting station 90 disposed between downstream end 36 of second transfer conveyor 24 and downstream end 44 of third transfer conveyor. Second junction resting station 90 is similar in configuration and function to first junction resting station 86. Second junction resting station 90 includes four spaced apart resting pads 92 for holding sand molds 38, and central transfer rails 52' and 52" of each of the second and third transfer conveyors 24 and 40, respectively, are alternatively movable between spaced apart resting pads 92 of second junction resting station 90.

Sand molds 38 placed upon second junction resting station 90 are moved from accumulating mold conveyor 20 to an associated metal pouring station, such as including a rotary mold handling table (not shown in FIG. 1). Pusher mechanism 94 is attached to third transfer conveyor 40. Pusher mechanism 94 includes a hydraulically activated pusher arm 96 adapted to push sand molds 38 off second junction resting station 90 and onto a platform of the associated pouring station.

This invention further includes a method for conveying a sand mold. The method of this invention uses an accumulating conveyor, such as described above, including a first transfer conveyor in conveying combination with a second transfer conveyor, each of the first and second transfer conveyors comprising two outboard rails and a central transfer rail movable between the two outboard rails.

In one embodiment of this invention, referring to FIG. 1, a first sand mold forming machine deposits first sand mold 38 on first transfer conveyor 22. In one embodiment of this invention, sand mold 38 is placed directly onto first transfer conveyor 22, without an optional bottom board, such as are known to those skilled in the art. Sand mold 38 moves along first transfer conveyor 22 in a first downstream direction indicated by arrow 100. First transfer conveyor 22 moves sand mold 38 by lifting the sand mold off outboard rails 46 and 48 with central transfer rail 52, moving central transfer rail 52 and the lifted sand mold 38 in the first downstream direction, and lowering the lifted sand mold 38 onto outboard rails 46 and 48. The steps for moving first sand mold 38 are repeated until first sand mold 38 is placed by central transfer rail 52 onto first junction resting station 86. Upon placing first sand mold 38 onto first junction resting station 86, central transfer rail 52 moves back upstream and out from under sand mold 38.

Central transfer rail 52' of second transfer conveyor 24 then moves under first sand mold 38 to transfer first sand mold 38 to second transfer conveyor 24. Central transfer rail 52' lifts first sand mold 38 off first junction resting station 86 and moves first sand mold 38 along second transfer conveyor 24 in the manner discussed above for first transfer conveyor 22, but in a second downstream direction, indicated by arrow 102, that is perpendicular to the downstream direction of first transfer conveyor 22. The steps for moving first sand mold 38 along second transfer conveyor 24 are incrementally repeated until first sand mold 38 is placed by central transfer rail 52 onto second junction resting station 90. Upon placing first sand mold 38 onto second junction resting station 90, central transfer rail 52 moves back upstream and out from under first sand mold 38.

The apparatus and method of this invention beneficially allow for sand molds produced by more than one sand mold forming machine to be directed into a single pouring station. A second sand mold forming machine deposits a second sand mold, represented in FIG. 1 by sand mold 38", onto third transfer conveyor 40. Central transfer rail 52" moves second sand mold 38" along third transfer conveyor 40 in the manner discussed above for first transfer conveyor 22, and in a downstream direction indicated by arrow 104 that is parallel to the downstream direction of first transfer conveyor 22. The steps for moving second sand mold 38" along third transfer conveyor 40 are repeated until second sand mold 38" is placed by central transfer rail 52" onto second junction resting station 90. Upon placing second sand mold 38" onto second junction resting station 90, central transfer rail 52" moves back upstream and out from under second sand mold 38".

Only one of the first and second sand molds 38 and 38" is placed on second junction resting station 90 at a given time. Pusher mechanism 94 pushes the sand mold placed upon second junction resting station 90 off to make room for the next sand mold. Various and alternative movement schemes are available for moving sand molds from more than one sand mold forming machine according to the invention. For example, sand molds can be continually and alternatively moved onto second junction resting station 90, e.g., first one from second transfer conveyor 24, then one from third transfer conveyor 40, then one again from second transfer conveyor 24, etc. Alternatively, multiple sand molds from the first sand mold forming machine can be moved to the pouring station, while the second forming machine is not needed or activated, and vice versa, depending on need. This embodiment can be particularly beneficial to allow one sand mold forming machine to continue while the other sand mold forming machine is being reconditioned or retooled. In one method of this invention, the presence or position of sand molds on the accumulating mold conveyor 20 are sensed, such as by sensors 82, as they incrementally move along the multiple transfer conveyors.

Figure 3:
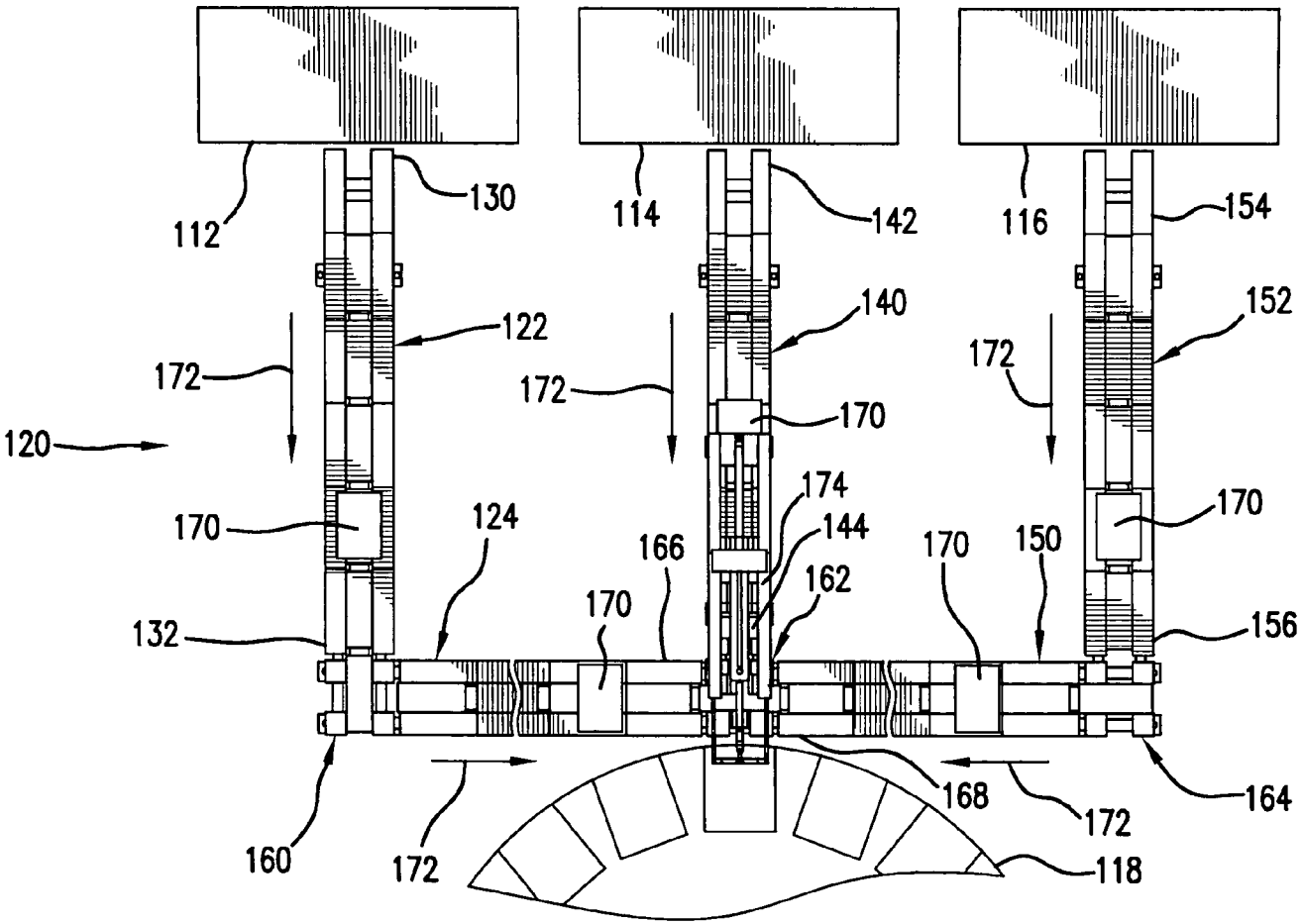
FIG. 3 is a top view of an accumulating mold conveyor according to another embodiment of this invention.

FIG. 3 illustrates an accumulating mold conveyor 120 according to another embodiment of this invention, for transporting sand molds from three sand mold forming stations 112, 114, and 116, respectively, to rotary mold handling table 118 of a metal pouring station.

Accumulating mold conveyor 120 includes first transfer conveyor 122 oriented in a first direction, and second transfer conveyor 124 oriented in a perpendicular second direction. First transfer conveyor 122 has an upstream end 130 that is disposed toward first sand mold forming station 112, and a downstream end 132 opposite the upstream end 130. Accumulating mold conveyor 120 includes third transfer conveyor 140 oriented in a third direction that is the same as the first direction and also perpendicular to the second direction. Third transfer conveyor 140 has upstream end 142 that is disposed toward second sand mold forming station 114 and downstream end 144 opposite upstream end 142. Accumulating mold conveyor 120 also includes fourth transfer conveyor 150 and fifth transfer conveyor 152. Fourth transfer conveyor 150 is parallel to and aligned with second transfer conveyor 124. Fifth transfer conveyor 152 is parallel to first and third transfer conveyor 122 and 140, and has upstream end 154 that is disposed toward third sand mold forming station 116, and downstream end 156 opposite upstream end 154. Each of the first through fifth transfer conveyors 122, 124, 140, 150, and 152, include a central transfer rail movable between two fixed outboard rails, and function as described above with reference to FIGS. 1 and 2. For sake of brevity, details about these components are incorporated from above, and not repeated here.

First transfer conveyor 122 is connected in conveying combination with second transfer conveyor 124 at first junction resting station 160. Fifth transfer conveyor 152 is connected in conveying combination with fourth transfer conveyor 150 at third junction resting station 164. Second junction resting station 162 is disposed at and between second transfer conveyor downstream end 166, third conveyor downstream end 144, and fourth conveyor downstream end 168. Sand molds 170 travel (in the manner described above) along the respective transfer conveyors of accumulating mold conveyor 120 from the sand mold forming machines 112, 114, or 116 to second junction resting station 162 in the directions indicated by arrows 172. Once reaching second junction resting station 162, sand molds 170 are pushed off second junction resting station 162 onto rotary mold handling table 118 by pusher mechanism 174.

As will be appreciated by those skilled in the art following the teachings herein provided, various and alternative configurations are available for the mold accumulating conveyor, transfer conveyors, and junction resting stations of this invention.

Thus, the invention provides a mold accumulating conveyor that feeds sand molds from multiple sand mold forming machines to a single metal pouring station. The accumulating mold conveyor of this invention improves efficiency of casting by, for example, allowing for a sand mold casting apparatus to continually run, even while one associated sand mold forming machine is offline. The mold accumulating conveyor of this invention also allows for differently configured sand molds to be simultaneously fed into a single pouring station.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

What is claimed is:

1. A method for conveying a sand mold, the method comprising:

providing an accumulating conveyor including a first transfer conveyor in conveying combination with a second transfer conveyor, each of the first and second transfer conveyors comprising at least one transfer rail movable with respect to at least one fixed rail;

moving the sand mold along the first transfer conveyor in a first direction;

transferring the sand mold from the first transfer conveyor to the second transfer conveyor; and moving the sand mold along the second transfer conveyor in a second direction that is different than the first direction;

wherein moving the sand mold along each of the first and second transfer conveyors comprises:

lifting the sand mold off the at least one fixed rail with the transfer rail;

moving the transfer rail and the lifted sand mold in a downstream direction; and lowering the lifted sand mold onto the at least one fixed rail.

2. The method according to claim 1, wherein the second direction is perpendicular to the first direction.

3. The method according to claim 1, further comprising sensing the position of the sand mold as it incrementally moves along at least one of the first and second transfer conveyors.

4. The method according to claim 1, wherein each of the first and second transfer conveyors comprises two fixed rails and the transfer rail is movable between the two fixed rails.

5. The method according to claim 1, further comprising pushing the sand mold off of the accumulating conveyor.

6. The method according to claim 1, wherein transferring the sand mold from the first transfer conveyor to the second transfer conveyor comprises:

lifting the sand mold off the at least one fixed rail of the first transfer conveyor with the first transfer conveyor transfer rail;

moving the first transfer conveyor transfer rail from a first position to a second position to dispose the lifted sand mold over a junction resting station;

lowering the lifted sand mold onto the junction resting station;

moving the lowered first transfer conveyor transfer rail from the second position to the first position;

moving the second transfer conveyor transfer rail under the sand mold on the junction resting station; and lifting the sand mold off the junction resting station with the second transfer conveyor transfer rail.

7. The method according to claim 6, further comprising:

placing the sand mold onto a second junction resting station at a downstream end of the second transfer conveyor with the transfer rail of the second transfer conveyor; and pushing the sand mold off the second junction resting station onto a rotary mold handling table.

8. The method according to claim 1, wherein the at least one transfer rail includes a frame and a plurality of carrier plates, wherein each of the plurality of carrier plates is attached along the frame by a pressurized fluid lift mechanism for lifting and lowering a corresponding carrier plate and a sand mold thereon.

9. A method for conveying a sand mold, the method comprising:

providing an accumulating conveyor including a first transfer conveyor in conveying combination with a second transfer conveyor, each of the first and second transfer conveyors comprising at least one transfer rail movable with respect to at least one fixed rail;

moving the sand mold along the first transfer conveyor in a first direction;

transferring the sand mold from the first transfer conveyor to the second transfer conveyor by placing the sand mold onto a junction resting station with the transfer rail of the first transfer conveyor, the junction resting station disposed at a downstream end of the first transfer conveyor and an upstream end of the second transfer conveyor, and lifting the sand mold off the junction resting station with the transfer rail of the second transfer conveyor; and moving the sand mold along the second transfer conveyor in a second direction that is different than the first direction.

10. The method according to claim 9, further comprising:

placing the sand mold onto a second junction resting station at a downstream end of the second transfer conveyor with the transfer rail of the second transfer conveyor; and pushing the sand mold off the second junction resting station onto a rotary mold handling table.

11. The method according to claim 9, wherein moving the sand mold along the first and second transfer conveyors comprises:

lifting the sand mold off the at least one fixed rail with the transfer rail;

moving the transfer rail and the lifted sand mold in a downstream direction; and lowering the lifted sand mold onto the at least one fixed rail.

12. The method according to claim 9, further comprising sensing with sensing mechanisms the presence of the sand mold at each of a plurality of resting positions disposed along the at least one transfer conveyor.

13. A method for conveying sand molds, the method comprising:

depositing a first sand mold on a first transfer conveyor, the first transfer conveyor including two outboard rails and a central transfer rail movable between the two outboard rails;

moving the first sand mold along the first transfer conveyor in a first direction;

placing the first sand mold on a first junction resting station, wherein the first junction resting section is at a downstream end of the first transfer conveyor and an upstream end of a second transfer conveyor, the second transfer conveyor including two outboard rails and a central transfer rail movable between the two outboard rails;

lifting the first sand mold off the first junction resting station with the central transfer rail of the second transfer conveyor;

moving the first sand mold along the second transfer conveyor in a second direction that is different than the first direction;

placing the first sand mold on a second junction resting station, wherein the second junction resting section is at a downstream end of the second transfer conveyor;

depositing a second sand mold on a third transfer conveyor, the third transfer conveyor including two outboard rails and a central transfer rail movable between the two outboard rails;

moving the second sand mold along the third transfer conveyor in a third direction that is different than the second direction; and placing the second sand mold on the second junction resting station, wherein the second junction resting station is a downstream end of the third transfer conveyor;

wherein only one of the first and second sand molds is placed on the second junction resting station at a time.

14. The method according to claim 13, wherein moving the first sand mold along the first and second transfer conveyors and moving the second sand mold along the third transfer conveyor comprises:

lifting the sand mold off the outboard rails with the central transfer rail;

moving the central transfer rail and the lifted sand mold in a downstream direction; and lowering the lifted sand mold onto the outboard rails.

15. method according to claim 13, wherein the second direction is perpendicular to the first and third directions.

16. The method according to claim 13, wherein placing the first sand mold on a first junction resting station comprises:

lifting the first sand mold off the first transfer conveyor outboard rails with the first transfer conveyor central transfer rail;

moving the first transfer conveyor central transfer rail from a first lifted position to a second lifted position to dispose the lifted first sand mold over a junction resting station;

lowering the lifted first sand mold onto the junction resting station.

17. The method according to claim 13, wherein upon placing the sand mold on the first junction resting station, the first transfer conveyor central transfer rail moves out from under the sand mold and the second transfer conveyor central transfer rail moves under the sand mold.

18. The method according to claim 13, further comprising pushing the first and second sand molds off the second junction resting station onto a rotary mold handling table.

* * * * *